United States Patent [19]

Pickell et al.

[11] Patent Number: 4,986,222

[45] Date of Patent: Jan. 22, 1991

[54] FURNACE FOR OIL REFINERIES AND PETROCHEMICAL PLANTS

[75] Inventors: Frank W. Pickell, Alvin; John Z. Varesic, Friendswood, both of Tex.; M. Shannon Melton, Tulsa; Sidney H. Melton, Broken Arrow, both of Okla.

[73] Assignee: Amoco Corporation, Chicago, Ill.

[21] Appl. No.: 399,307

[22] Filed: Aug. 28, 1989

[51] Int. Cl.[5] ..... F22B 37/00

[52] U.S. Cl. ..... 122/6 R; 110/336; 122/6 A; 122/250 R

[58] Field of Search ..... 122/18, 6 A, 250 R, 122/6 R; 110/336

[56] References Cited

U.S. PATENT DOCUMENTS

| | | | |
|---|---|---|---|
| 4,332,552 | 6/1982 | Seelahdt | 110/336 X |
| 4,494,485 | 1/1985 | Kendall et al. | 122/18 X |
| 4,658,762 | 4/1987 | Kendall | 122/18 X |
| 4,840,131 | 6/1989 | Meumann et al. | 110/336 |

*Primary Examiner*—Edward G. Favors

*Attorney, Agent, or Firm*—Thomas W. Tolpin; William H. Magidson; Ralph C. Medhurst

[57] ABSTRACT

An economical, efficient, compact furnace is provided with horizontal radiant furnace tubes that extend along all the walls of the furnace for uniform heat distribution and load. The furnace is particularly useful in oil refineries and petrochemical plants. The furnace also has a special pattern of burners for safer, more effective heat transfer.

12 Claims, 4 Drawing Sheets

FURNACE FOR OIL REFINERIES AND PETROCHEMICAL PLANTS

BACKGROUND OF THE INVENTION

This invention relates to furnaces and, more particularly, to furnaces for use in oil refineries and petrochemical plants.

There are many variations in the layout, design, and detailed construction of fired heaters and furnaces. In fact, most fired heaters and furnaces are custom engineered for a particular application.

The simplest type of fired heaters (furnaces) comprise the "all radiant" design, in which the entire radiant tubes or coils are arranged vertically along the walls of the radiant section of the combustion chamber. This design is characterized by low thermal efficiency and typically represents the lowest capital investment for a specified duty. The terminology "all radiant" is somewhat of a misnomer since convection currents do exist because of the flow of flue gases through the combustion chamber and such convection currents account for a portion of the total heat absorbed in the radiant section.

Other types of fired heaters (furnaces) have a separate convection section. The residual heat of the flue gases leaving the radiant section is recovered in the convection section primarily by convection. The convection section can increase the thermal efficiency of the fired heater. The first few rows of tubes in the convection section are sometimes referred to as shield tubes or shock tubes.

The principal classification of fired heaters (furnaces), however, relates to the orientation of the heating coil in the radiant section, i.e., whether the tubes are vertical or horizontal.

In the vertical cylindrical radiant fired heater (furnace), the tube coil is placed vertically along the walls of the combustion chamber. Firing is also vertical from the floor of the vertical heater. Vertical heaters are low in cost and require a minimum of plot area but are low in efficiency. Typical duties are from 0.5 to 50 million Btu/hr. The advantages of vertical cylindrical fired heaters (furnaces) are their: (1) high tube area to structural steel weight ratio, resulting in a low cost per Btu absorbed duty, and (2) minimum of plot plan area. The disadvantages of the furnaces are that they require vertical radiant tubes to carry the process stream from areas of high heat flux to areas of low heat flux several times in each pass resulting in inefficient mediocre heat transfer. Also, the coils in vertical cylindrical fired heaters are not self-draining, causing difficulty in hydrocarbon freeing the tubes which often causes the tubes to become coked or otherwise blocked, resulting in extended downtime for furnace maintenance. Furthermore, if one pass of the vertical tubes is filled with liquid, a no flow condition can occur in that pass until sufficient pressure drop exists across the entire furnace to overcome the vertical liquid head in a full tube; this condition has numerous tube ruptures and furnace fires in vertical cylindrical fired heaters.

In helical coiled fired heaters, sometimes referred to as vertical cylindrical helical coiled fired heaters (furnaces), the coils are arranged helically along the walls of the combustion chamber and firing is vertical from the floor. These heaters are low in cost and have drainable tube coils but are low in efficiency. One limitation on these units is that generally only one flow path is followed by the process fluid. Heating duties range from 0.5 to 20 million Btu/hr. The advantages of helical coil cylindrical fired heaters are that they require a minimum of plot plan area and have a low cost per Btu absorbed duty as well as have a countercurrent flow of the in-tube process stream with the flue combustion gases. The disadvantages of the helical coil cylindrical fired heaters are that they are generally limited to one or two radiant passes thereby requiring increased pressure drops. Also, their maximum overall outside diameter is usually limited to about 15 feet due to shipping limitations on trucks and railways. Larger diameter helical coil fired heaters must be shipped by barge which is more expensive. Furthermore, each loop of the radiant coil in helical coiled fired heaters must be welded together at the erection (construction) site which can be very expensive. Fabrication of helical coil is also expensive. Supporting of an helical coil is probably due to irregular coil thermal expansion.

Vertical cylindrical fired heaters (furnaces) with cross flow convection are also fired vertically from the floor but have both radiant and convection sections. The radiant section tube coil is disposed in a vertical arrangement along the walls of the combustion chamber. The convection section tube coils are arranged as a horizontal bank of tubes positioned above the combustion chamber. Typical duty ranges from 10 to 200 million Btu/hr. The vertical cylindrical fired heater with cross flow convection is more thermally efficient than the oil radiant vertical cylindrical fired heater but has many similar disadvantages.

Another type of vertical cylindrical fired heater is that with integral convection. Vertical cylindrical fired heaters (furnaces) with integral convection are vertically fired from the floor with their tube coils installed in a vertical arrangement along the walls. The distinguishing feature of this type of fired heater is the use of added surface area on the upper reaches of each tube to promote convection heating. The surface area extends into the annular space formed between the convection coil and a central baffle sleeve. Medium efficiency can be attained with a minimum of plot area with vertical cylindrical fired heaters with integral convection. Typical duty for this design is from 10 to 100 million Btu/hr.

The arbor or wicked fired heater (furnace) is a specialty design in which the radiant heating surface is provided by U-tubes connecting the inlet and the outlet terminal manifolds. This fired heater is especially useful for heating large flows of gas from the conditions of low pressure drop, such as is employed in a catalyticreformer charge heater. Firing modes are usually vertical from the floor or horizontal between the riser portion of the U-tubes. This design can be expanded to accommodate several arbor coils within one structure. Each coil can be separated by dividing walls so that individual firing control can be attained. In addition, a cross flow convection section can be installed to provide supplementary heating capacity for chores such as steam generation. Typical duties for each arbor coil are about 50 to 100 million Btu/hr.

Another type of vertical fired heater is the vertical tube, double fired heater. In vertical tubes, double fired heaters (furnaces), vertical radiant tubes are arranged in a single row,in each combustion cell. There are often two cells and the tubes are fired from both sides of the row. A more uniform distribution of heat transfer rates and heat flux are accomplished with vertical tube, double fired heaters than in the heaters previously described. Vertical tube, double fired heaters can use multilevel side wall firing to provide maximum control of the heat flux profile along the length of the tubes. The limited number of tubes could be used, making very low firebox utilization. The typical duty range for each cell runs from about 20 to 125 million Btu/hr. Vertical tube, double fired furnaces, however, are very expensive.

In horizontal tube cabin double fired heaters (furnaces), radiant section tube coils are arranged horizontally in the middle of the heater away from the furnace walls. The convection section to the coil's position has a horizontal bank of tubes above the combustion chamber. Normally these tubes are fired vertically from the floor but they can also be fired horizontally by side wall mounted burners located below the tube coil. These fired heaters range from 10 to 100 million Btu/hr. Horizontal tube cabin double fired heaters are more economical and efficient than the other prior art fired heaters discussed above. The coils are self-draining. These fired heaters are somewhat easier to ship and erect because of segmental fabrication. The disadvantages of the horizontal tube cabin double fired heater are that there are bare end walls without any radiant tubes, which substantially decreases the thermal efficiency of the fired heater. Furthermore, horizontal tube cabin double fired heaters require a large plot plan area and have a very low tube to structural steel weight ratio.

The two cell horizontal tube box fired heater (furnace) has a radiant section tube coil positioned in a horizontal arrangement along the side walls and the roof of the two combustion chambers. These fired heaters are vertically fired from the floor and have a typical duty ranging from 100 to 250 million Btu/hr. The advantages and disadvantages of this heater are similar to that of the horizontal tube cabin fired heater.

Another type of horizontal tube fired heater is the horizontal tube cabin fired heater (furnace) with a dividing bridgewall in which a radiant section tube coil is arranged horizontally along the side wall of the combustion chamber and along the hip. The convection section tube coil takes the form of a horizontal bank of tubes positioned above the combustion chamber. A dividing bridgewall between the cells allows for individual firing control over each cell in the combustion chamber. These heaters have a typical duty ranging from 20 to 100 million Btu/hr. The advantages and disadvantages of this fired heater are similar to horizontal tube cabin fired heaters discussed above.

End fired horizontal tube box fired heaters (furnaces) have a radiant section tube coil positioned in a horizontal arrangement along the side walls and the roof of the combustion chamber. The convection section tube coil is also arranged as a horizontal bank of tubes positioned above the combustion chamber. These furnaces are horizontally fired by burners mounted in the end walls. Typical duty ranges for this design are from 5 to 50 million Btu/hr. The advantages and disadvantages of this fired heater are similar to the horizontal tube cabin fired heater.

In the end fired horizontal tube box fired heater (furnace), a side mounted convection section has a radiant section tube coil disposed in a horizontal arrangement along the side walls and the roof of the combustion chamber. The convection section coil, however, is arranged as a horizontal bank of tubes positioned alongside the chamber. The unit is horizontally fired from burners mounted on the end wall. These furnaces are found in many older installations and are very expensive to construct and maintain. Typical duties range from 50 to 200 million Btu/hr. The advantages and disadvantages of this fired heater are similar in many respects to the horizontal tube cabin fired heater.

It is therefore desirable to provide an improved fired heater (furnace) which overcomes many, if not most, of the preceding problems.

SUMMARY OF THE INVENTION

An improved furnace (fired heater) is provided which is particularly useful in oil refineries and petrochemical plants. The improved furnace is effective, efficient, and relatively compact. Advantageously, the novel furnace provides uniform pressure drops and heat transfer, reduces air leaks, is equipped with drainable coils, and provides easy access for coil repairs. Desirably, the novel furnace can be used on existing foundations and is economical to construct, operate, and maintain.

To this end, the novel furnace has: burners to heat a hydrocarbon feedstock; a stack positioned above the burner to discharge combustion gases emitted from the burners; walls which peripherally enclose and annularly surround the burners; and substantially uniform heat distribution means including a set of substantially horizontal radiant furnace tubes which extend along the walls to pass and convey the hydrocarbon feedstock about the burners. In order to further enhance uniform heat distribution, the burners preferably include at least one elongated high intensity burner and an array (set) of generally flat flame burners surrounding the high intensity burner(s). For even greater furnace efficiency and decreased downtime, the tubes comprise drainable tubes.

In the preferred form, the furnace comprises a radiant rectangular or square box heater with generally rectangular upright composite walls. The composite walls have outer metal panels with inner insulating ceramic fiber refractory modules. Preferably, the walls include at least one bolted flanged corner to facilitate access to the tubes for welding and other repairs.

In order to provide for more effective heat transfer and decrease the overall weight of the furnace, the furnace of the preferred embodiment has a composite floor with high temperature refractory bricks, high temperature and strain resistant ceramic fiber boards and high density ceramic fiber modules, as well as a carbon steel bottom plate with a corrosion resistant coating.

Advantageously, the novel furnace requires a minimum of plot plan area. It has a high tube area to structural steel weight ratio thereby yielding a low initial cost per Btu absorbed duty. Desirably, the self-draining coils keep maintenance and downtime to a minimum and prevent loss of flow in the coils due to liquid filled conditions.

The furnace can be fabricated in sections to facilitate economical shipping and minimize construction costs. Preferably, the novel furnace has in-tube process flow which is countercurrent to the flue gas flow to maximize heat transfer efficiency. The tubular arrangement in the furnace can be adapted to multiple passes to reduce or minimize in-tube process pressure drops.

All the walls of the furnace are preferably substantially covered with tubes so that there are no bare walls which would otherwise reduce thermal efficiency. The novel furnace can achieve a thermal efficiency of 85% to 90% or higher.

A more detailed explanation is provided in the following description and appended claims taken in conjunction with the accompanying drawings.

DETAILED DESCRIPTION OF THE PREFERRED EMBODIMENT

Figure 1:
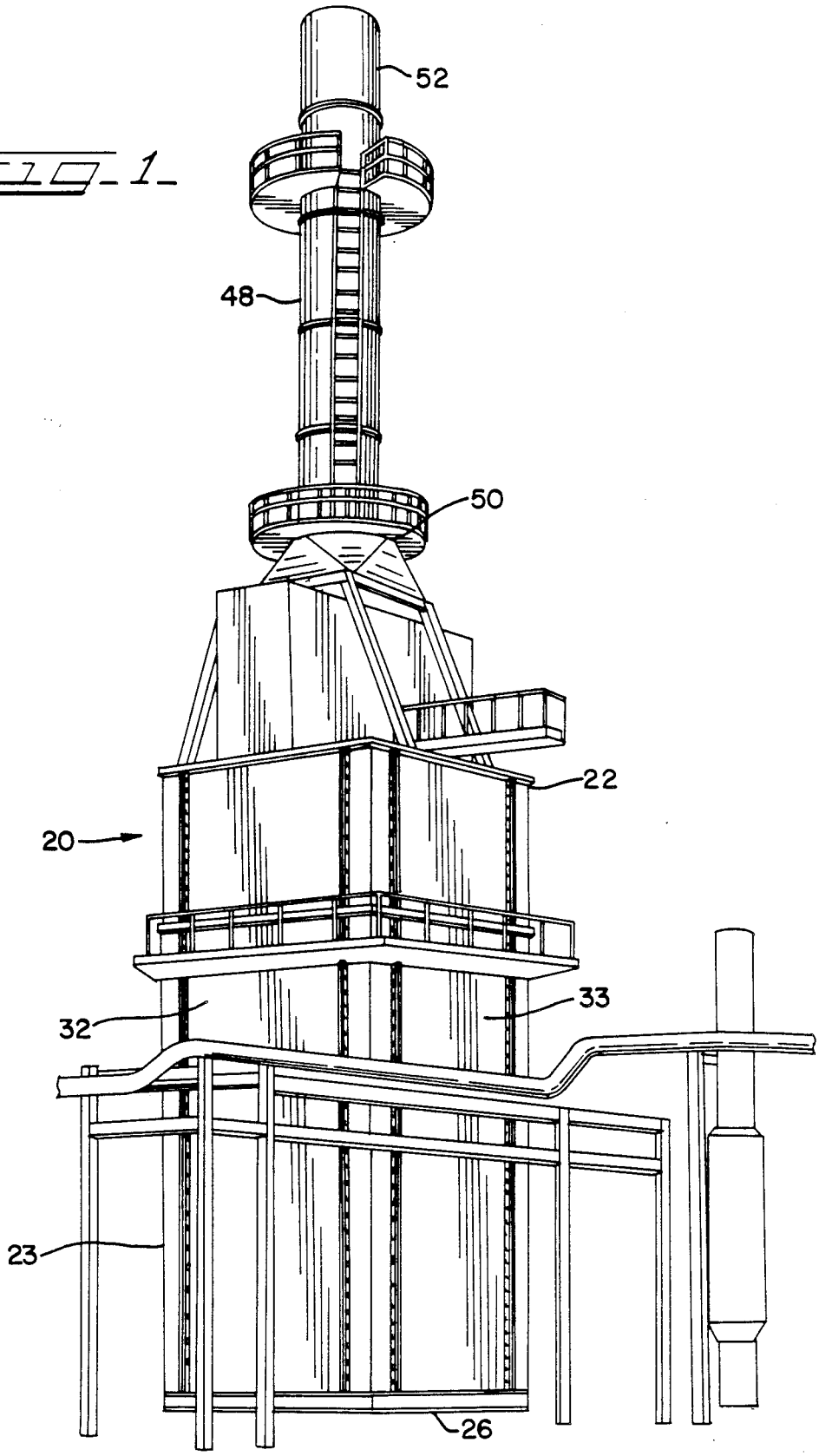
FIG. 1 is a perspective view of a furnace in accordance with principles of the present invention.

The bottom fired fixed vertical heater 20 of FIG. 1 comprises an efficient furnace which effectively heats a hydrocarbon feedstock, such as a blend (mixture) of hydrogen-containing gases and sulfur-containing oil, preferably naphtha, before the feedstock is desulfurized in a desulfurizing unit and up graded in a reforming unit (ultra-former) to higher octane gasoline and aromatic chemical feedstocks, such as toluene, benzene, xylene, etc.

Figure 2:
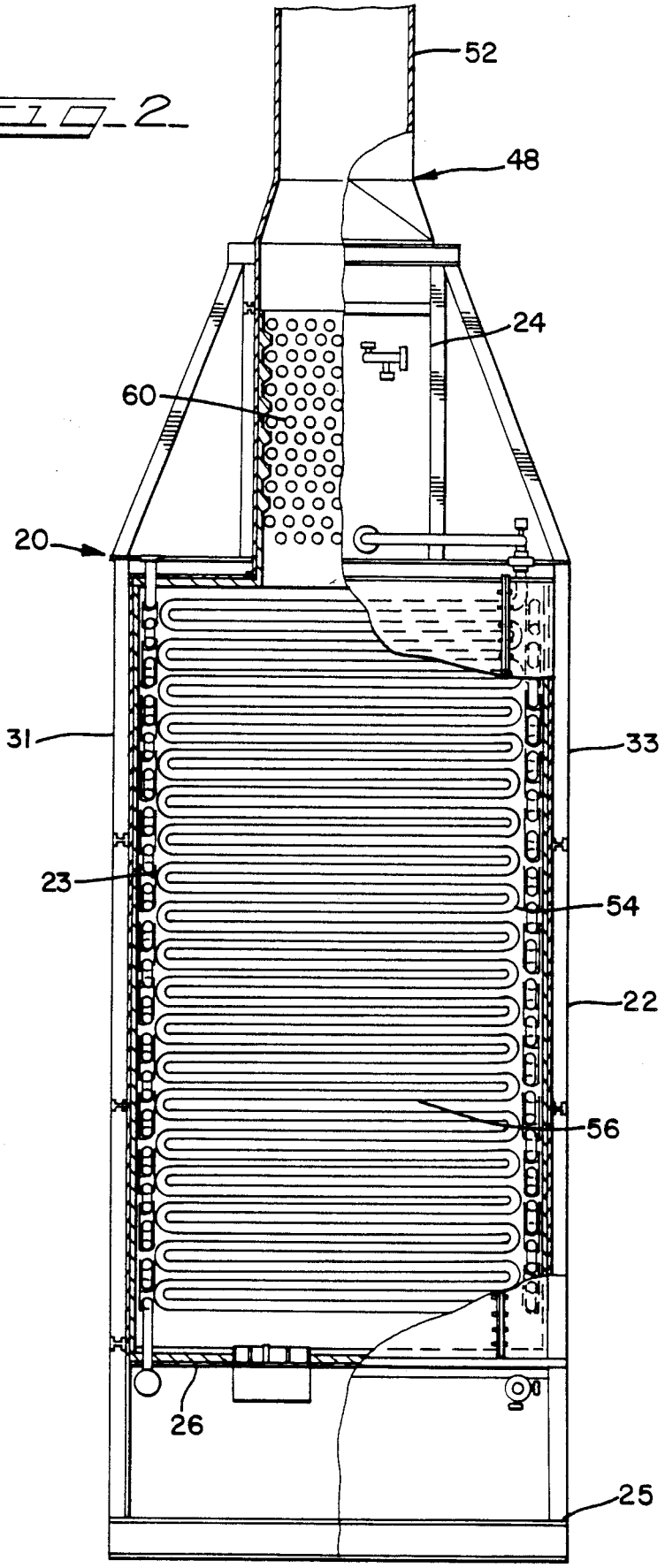
FIG. 2 is a fragmentary cross-sectional side view of the furnace.

The furnace 20 (FIG. 2) comprises a radiant square box heater 22 with a radiant tube section 23, a convection section 24 positioned above the radiant section 23 and having a smaller square cross-sectional area than the radiant section 23 as viewed from the top, a foundation 25 positioned below and supporting the radiant section 23 and furnace walls, a composite ceramic floor 26 with a central portion 28 (FIG. 3) and a peripheral portion 30 secured to the foundation 25 (FIG. 2). Rectangular upright composite furnace walls 31–34 (FIG. 3) extend vertically upwardly from the floor 26 about the radiant section 23. The composite walls, such as wall 31 of FIG. 5, each have an outer steel plate panel 36, inner insulation comprising ceramic fiber refractory modules 38, inwardly extending tube (coil) supports 40, and a retaining bar assembly 41 comprising retaining bars 42 and clevises 44 with bolts 46 or other fasteners. An annular upright stack 48 (FIGS. 1 and 2) has a lower portion 50 and an upper portion 52 which extend upwardly above the radiant section, central portion, and walls of the furnace 20.

Stainless steel oil resistant radiant coils 54 (FIG. 2) are heat treated to avoid cold cracking. The radiant coils 54 comprise horizontal rows of drainable radiant furnace tubes (coils) 56 which are positioned inwardly of the fiber refractory modules 38 (FIG. 5) and against the tube supports 40 and retaining bar assemblies 41. The radiant furnace tubes 56 substantially cover the inward surface area of the furnace walls and provide substantially uniform heat transfer of the radiant heat from the burners 58 (FIG. 3) to the feedstock which is conveyed and passed through the radiant tubes 56. The retaining bar assemblies 41 (FIG. 5) are provided to support and mount the radiant furnace tubes 56 to the tube supports 40.

Positioned above the radiant tubes 56 (FIG. 2) in the convection section 24 (chamber), are stainless steel heat treated oil-resistant convection coils (tubes) 60. The convection coils 60 communicate with the radiant coils 56 to receive, convey and pass the hydrocarbon feedstock from the radiant coils 56 to a desulfurizing unit.

An array of gas fired burners 58 (FIG. 3), which are preferably fueled with hydrogen and/or light hydrocarbon gases, such as methane, ethane, propane, acetylene, etc., are mounted on the floor 26 of the furnace to radiantly heat the naphtha and hydrogen-containing gas feedstock in the radiant tubes 56. The burners emit hot combustion flue gases or stack gases to convectively heat the radiantly heated naphtha and hydrogen gas-containing gas feedstock in the horizontal rows of drainable convection tubes 60 (FIG. 2). The combustion flue (stack gases) are discharged upwardly through the stack 48. In order to enhance uniform radiant heating of the feedstock in the radiant tubes 56, the burners 58 (FIGS. 3 and 4) are arranged in a special pattern including central burners 62 comprising from 2 to 4 vertically elongated, high intensity burners positioned in the central portion 28 of the ceramic floor 26 and outer peripheral burners 64 comprising from 4 to 8 substantially flat, lesser intensity burners positioned in proximity to the peripheral portion 30 of the ceramic floor 26. For better results and higher throughput, the burners 58 comprise 4 symmetrical high intensity burners 62 in the central portion 28 of the ceramic floor 26 and a square symmetrical array (set) of flat lesser intensity burners 64 symmetrically surrounding and coaxially positioned about the high intensity central burners 62 in the peripheral portion 30 of the ceramic floor 26. This burner pattern provides for a flamed density which substantially achieves equal heat loading and uniform heat distribution of the radiant tubes 56 and prevents overheating of the bottom portion of the tubes 56 as commonly occurs in prior art furnaces. In some circumstances, it may be desirable that the burners be arranged in an asymmetrical or offset pattern.

In order to facilitate access to the radiant tubes 56 for welding, repairing, and decoking, the corners 66 (FIG. 3) of the upright walls 31–34 of the radiant square box furnace have flanges 68 with removable bolts 70. The removable bolted flanged corners 66 also permit maintenance personnel to move the radiant tubes 56 laterally without removing the walls or cutting the tubes 56 which were often required with prior art furnaces.

Figure 3:
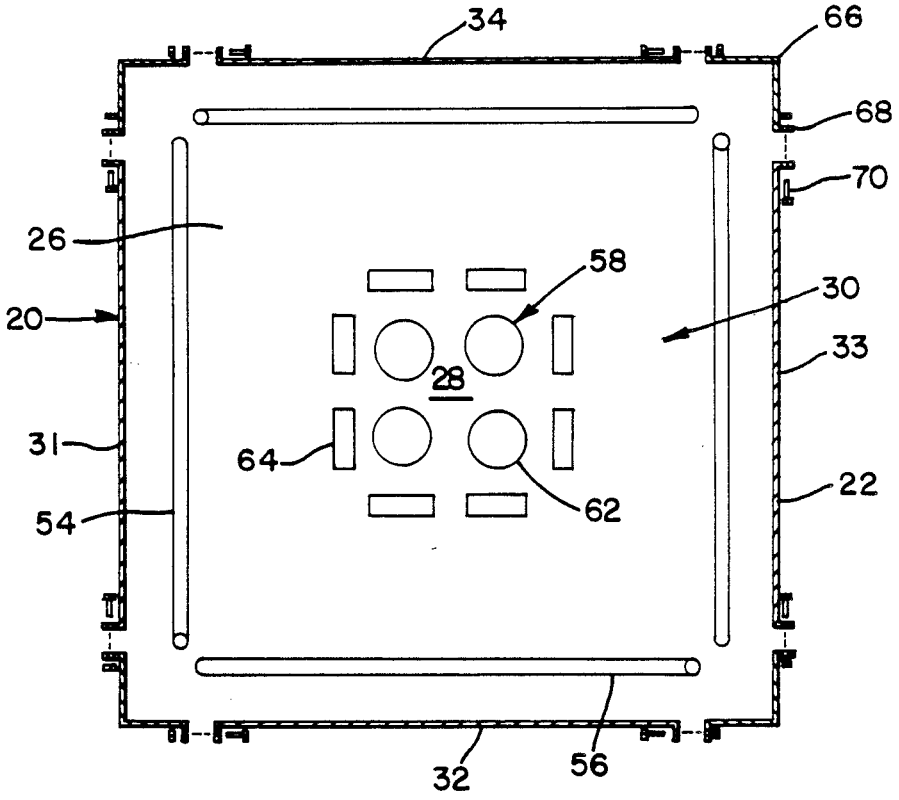
FIG. 3 is a cross-sectional view of the bottom portion of the radiant section of the furnace.
Figure 4:
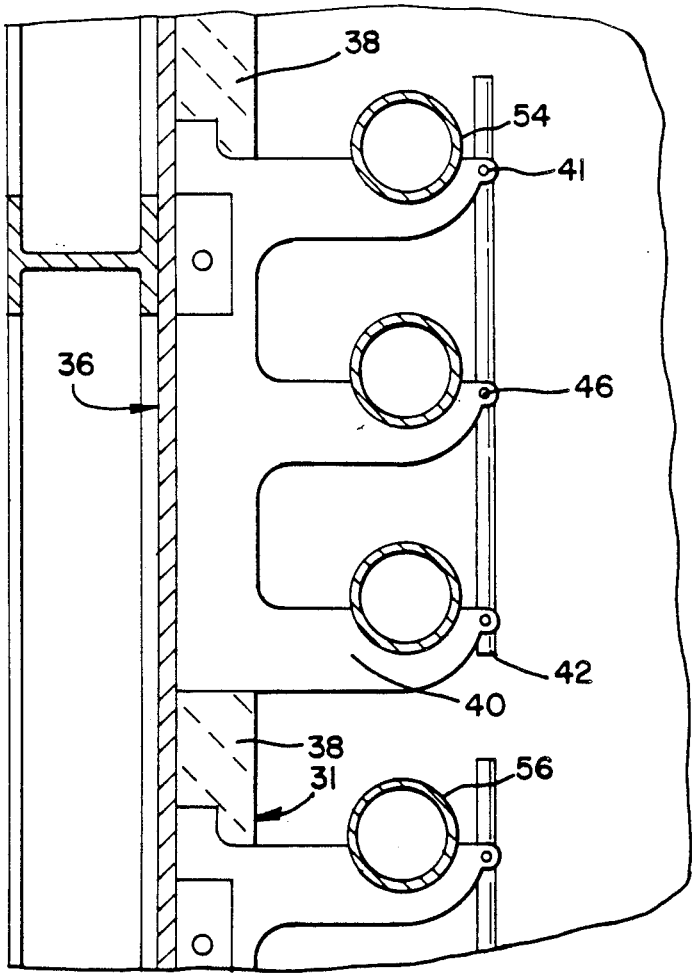
FIG. 4 is an enlarged cross-sectional view of the composite wall, coils and supports therefor.
Figure 5:
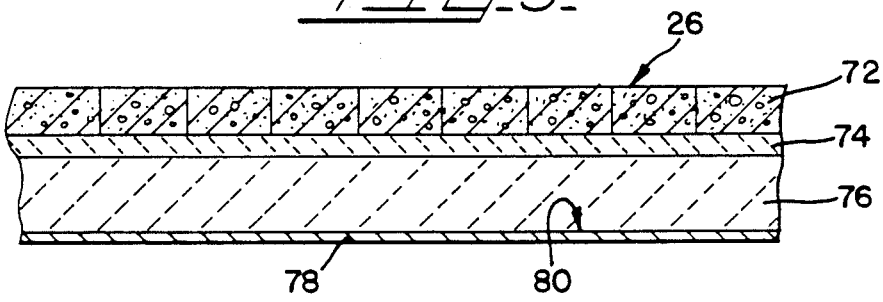
FIG. 5 is a cross-sectional view of the composite floor of the furnace.

As best shown in FIG. 5, the composite floor 26 of the furnace comprises a ceramic floor assembly which has: (a) high temperature refractory bricks 72 which are positioned around the burners 58 (FIG. 3); (b) high temperature, strain resistant, ceramic fiber boards 74 (FIG. 6) which are positioned beneath the bricks 72; (c) high density ceramic fiber modules 76 which are positioned beneath the ceramic fiber boards 74; and (d) carbon steel bottom plates 78 with a corrosion resistant mastic undercoating 80 positioned beneath the high density modules. The composite ceramic floor 26 is very efficient and lightweight. Desirably, the ceramic composite floor 26 has low heat accumulation, very low overall heat transfer, and does not trap, contain, or accumulate substantial moisture as in the typical floors of prior art furnaces. Prior art moisture-accumulating floors should be avoided, if possible, because they can explode from excess pressure if heated too quickly.

As shown in FIG. 3, the square vertical furnace 20 has radiant tubes 56 which run horizontally in passes descending along the inside of the furnace walls 31–34 between the burners 58 and the refractory walls. The plan of the radiant section is square and all walls 31–34 of the radiant section are covered with radiant tubes 56.

There are no bare end walls of the inventive furnace. The corners 66 of the radiant section are removable in sections to allow access to and removal of the radiant tubes 56. If desired, the furnace can have a two pass coil, a four pass coil, or an eight pass coil. Other numbers of pass coils are possible, if desired.

EXAMPLE

The novel furnace as described above was constructed and tested at the Amoco Oil Company refinery at Texas City, Tex. The furnace was designed for an operating process temperature of about 850° F. at a pressure of about 900 psig and a maximum tube and the wall temperature of 1000° F. The inlet of the furnace operated at about 418° F. at a pressure of 800 psig. The outlet of the furnace operated at about 690° F. at a pressure of about 768 psig at an absorbed rate or duty of about 80 million Btu/hr. The burners in the furnace included four 16–18 million Btu/hr central high intensity burners and eight 4–6 million Btu/hr peripheral flat flame burners surrounding the high intensity long flame central burners. The furnace was successful in providing for efficient uniform heating of the mixture of hydrogen and naphtha in the radiant and convection coils. The removable flanged bolted corners provided easy access to the radiant tube for adjustment. The composite ceramic floor provided excellent insulation from heat and successfully resisted moisture accumulation. The furnace was successfully erected on an existing foundation. The furnace was quickly ignited and brought up to operating temperatures and pressures.

Among the many advantages of the novel furnace are:

1. Outstanding performance.
2. Superior thermal efficiency.
3. Uniform heat distribution and heat transfer.
4. All internal coils.
5. Easier access to adjust, remove, weld, decoke, and repair the furnace tubes.
6. Less downtime.
7. Lower maintenance costs.
8. Improved heating of feedstock.
9. Compact.
10. Safe.
11. Effective.

Although embodiments of this invention have been shown and described, it is to be understood that various modifications and substitutions, as well as rearrangements of parts and equipment, can be made by those skilled in the art without departing from the novel spirit and the scope of this invention.

What is claimed is:

1. A furnace for use in oil refineries and petrochemical plants, comprising:

burner means for heating a hydrocarbon feedstock;

stack means positioned above said burner for discharging combustion gases emitted from said burner means;

wall means peripherally enclosing and annularly surrounding said burning means;

substantially uniform heat distribution including a set of substantially horizontal radiant furnace tubes extending along said wall means for passage of said hydrocarbon feedstock about said burner means; and a composite floor under said burner means having refractory bricks, temperature and strain resistant ceramic fiber boards beneath said bricks, high density ceramic fiber modules beneath said boards, and a carbon steel plate beneath said modules with an underside having a corrosion resistant coating.

2. A furnace for use in oil refineries and petrochemical plants, comprising:

burner means for heating a hydrocarbon feedstock;

stack means positioned above said burner for discharging combustion gases emitted from said burner means;

wall means peripherally enclosing and annularly surrounding said burning means;

substantially uniform heat distribution including a set of substantially horizontal radiant furnace tubes extending along said wall means for passage of said hydrocarbon feedstock about said burner means; and said burner means comprising at least one elongated high intensity burner and an array of generally flat flame burners surrounding said high intensity burner.

3. A furnace in accordance with claim 2 wherein said wall means comprises a radiant box with generally rectangular upright walls.

4. A furnace in accordance with claim 3 wherein said walls comprise composite walls having a metal panel with a ceramic fiber refractory module.

5. A furnace in accordance with claim 2 wherein said tubes comprise drainable tubes.

6. A furnace in accordance with claim 2 including a convection chamber with convection tubes positioned above said burner means.

7. A furnace in accordance with claim 2 wherein said wall means include at least one bolted flanged corner for facilitating access to said tubes for welding and other repairs.

8. A furnace for use in oil refineries and petrochemical plants, comprising:

a radiant box heater having a foundation, a composite ceramic floor with a central portion and a peripheral portion secured upon said foundation, a radiant section with substantially rectangular upright composite walls extending upwardly from said floor, a convection section positioned above said radiant section and an annular upright stack having a lower portion and an upper portion extending upwardly above said radiant section, central portion and said walls, said convection section having a smaller cross-sectional area than said radiant section, said composite walls having an outer steel panel, inner insulation comprising ceramic fiber refractory modules, and inwardly extending tube supports;

stainless steel heat treated, oil resistant, radiant coils mounted in said radiant section, said radiant coils comprising substantially horizontal rows of drainable radiant furnace tubes positioned inwardly of said fiber refractory modules and against said tube supports, said radiant furnace tubes substantially covering said walls for passing and conveying a hydrocarbon feedstock and for providing substantially uniform heat transfer to said feedstock along said walls, and retaining bars for mounting said radiant furnace tubes to said tube supports;

stainless steel heat treated, oil resistant convection coils mounted in said convection section and communicating with said radiant coils for receiving and conveying said hydrocarbon feedstock from said radiant coils, said convection coils comprising substantially horizontal rows of drainable convection tubes; and an array of burners mounted on said floor for radiantly heating said feedstock in said radiant tubes and for emitting hot combustion flue gases for convectively heating said feedstock in said convection tubes, said combustion gases being discharged upwardly through said stack, said burners being arranged in a pattern for substantially enhancing uniform radiant heating of said feedstock in said radiant tubes including from 2 to 4 elongated, high intensity burners positioned in said central portion of said ceramic floor and from 4 to 8 substantially flat, lesser intensity burners positioned in said peripheral portion of said ceramic floor.

9. A furnace in accordance with claim 8 wherein said radiant section and said convection section comprise substantially square sections as viewed from said stack and said burners comprise gas fired burners fueled with a hydrogen-containing gas selected from the group consisting of hydrogen, light hydrocarbon gases, and combinations thereof.

10. A furnace in accordance with claim 8 wherein said heater is located upstream of a desulfurizer unit and a reforming unit, and said feedstock includes a mixture of hydrogen-containing gases and sulfur-containing oil comprising naphtha.

11. A furnace in accordance with claim 8 wherein said walls include bolted flanged corners for facilitating access to said radiant tubes for welding, repairing, and decoking said radiant tubes.

12. A furnace in accordance with claim 11 wherein said composite floor comprises:

high temperature refractory bricks positioned adjacent and supporting said burners;

high temperature, strain resistant, ceramic fiber boards positioned beneath said bricks;

high density ceramic fiber modules positioned beneath said boards; and a carbon steel bottom plate with a corrosion resistant undercoating positioned beneath said high density modules.

* * * * *